United States Patent [19]

Bolton et al.

[11] 4,107,939

[45] Aug. 22, 1978

[54] APPARATUS FOR REDUCING EXTERIOR CONDENSATION IN AN AIR CONDITIONER

[75] Inventors: Theodore S. Bolton, Liverpool; Charles N. High, Cazenovia, both of N.Y.

[73] Assignee: Carrier Corporation, Syracuse, N.Y.

[21] Appl. No.: 783,873

[22] Filed: Apr. 1, 1977

[51] Int. Cl.[2] ..... F25B 47/00; F25D 17/06

[52] U.S. Cl. ..... 62/89; 62/280; 261/90; 261/92

[58] Field of Search ..... 62/280, 291.89; 261/90–92

[56] References Cited

U.S. PATENT DOCUMENTS

| | | | |
|---|---|---|---|
| 2,186,371 | 1/1940 | Durdin, Jr. | 261/91 X |
| 2,428,842 | 10/1947 | Feinberg | 261/90 X |
| 3,059,447 | 10/1962 | Brugler | 62/280 X |
| 3,576,316 | 4/1971 | Kaelin | 261/91 |
| 3,811,293 | 5/1974 | Flynn | 62/280 |
| 3,872,684 | 3/1975 | Scott | 62/280 X |

*Primary Examiner*—William E. Wayner
*Assistant Examiner*—William E. Tapolcai, Jr.
*Attorney, Agent, or Firm*—J. Raymond Curtin; Robert P. Hayter

[57] ABSTRACT

Apparatus in an air conditioning unit to provide for circulation of evaporator condensate preventing the formation of pockets of cold condensate which cause exterior condensation on the unit, the apparatus comprising a reservoir area for the collection of condensate, a condenser fan shroud dividing the reservoir into two parts and sluiceways within the shroud defining a path for circulation of the condensate communicating with the reservoir, and a powered rotatable fan which creates air pressure differentials which cause the condensate in the reservoir to circulate.

5 Claims, 3 Drawing Figures

APPARATUS FOR REDUCING EXTERIOR CONDENSATION IN AN AIR CONDITIONER

BACKGROUND OF THE INVENTION

The present invention relates to air conditioning units which collect evaporator condensate. More specifically the present invention relates to apparatus in an air conditioning unit for circulating the collected condensate to avoid cold pockets causing condensation on the exterior of the unit.

Air conditioning units such as the so-called self contained air conditioning units commonly used for residential and similar applications, generally include closed refrigeration circuits having an evaporator and a condenser. The unit is normally divided by a partition into an evaporator section and a condenser section, with the evaporator section communicating with the room air to be conditioned and the condenser section communicating with external air such as outdoor air. Refrigerant flows through the refrigeration circuit absorbing heat from the room air at the evaporator and discharging heat to the external air at the condenser. The conventional refrigeration circuit is completed by the addition of a compressor and an expansion device and the appropriate connections between the components.

In the evaporator section air is drawn through the evaporator by the evaporator fan and subsequently discharged into the room. In the evaporator, the refrigerant changes from a liquid state to a gaseous state absorbing heat from the air during the conversion. The temperature of the evaporator during operation is usually below the dew point of the air from which the heat is absorbed. Hence as the air cools, part of the moisture contained as a gas therein condenses into the liquid state and collects on the evaporator surfaces. This condensate is collected by a drain pan under the evaporator and gravity fed through the partition dividing the unit into sections.

In the condenser section, the condensate is disposed of by either draining it to an outside area or by evaporating the condensate at the condenser. The condenser receives hot compressed refrigerant from the compressor and must cool the refrigerant before it passes to the evaporator. A condenser fan is used to circulate air through the condenser for the purpose of absorbing heat. It has, however, been found that if small droplets of condensate are blown against the condenser, the condensate will not only be disposed of by evaporation but the condenser will become more efficient. A slinger such as shown in U.S. Pat. No. 3,766,751 is a device for distributing condensate onto the condenser.

The slinger is often a device mounted to the condenser fan which physically contacts the condensate or creates sufficient eddy currents to lift the condensate into the airstream of the condenser fan to be blown onto the condenser surfaces.

The base pan of the condenser section of the unit forms a reservoir for the collection of condensate.

A condenser fan shroud is usually mounted in the condenser section of the unit to serve as both an air flow guide into the condenser and to further define a path between air entering the unit as well as air being discharged from the unit. This condenser fan shroud also serves to divide the reservoir created in the base pan into two sections.

Previously without other means being provided, cold water draining directly from the evaporator was able to collect in specific areas of the reservoir and would be sufficiently cold to lower the temperature of the exterior of the base pan below the dew point temperature of the adjacent air resulting in condensation being formed on the exterior of the unit.

The present invention provides for sluiceways extending through the condenser fan shroud in communication with the condensate, thereby defining a path in which the condensate may circulate. Air pressure differentials created by the fan when in operation cause the condensate to circulate, mixing the standing warmer condensate with the colder condensate forming on the evaporator and eliminating the cold pockets causing condensation of the exterior of the unit.

Other methods of preventing cold pockets of condensate while effective are more complex and more expensive. For instance, the base pan could be insulated to prevent sweating or a stirring means could be installed for circulation of the collected condensate.

SUMMARY OF THE INVENTION

An object of the invention is to prevent exterior condensation on an air conditioning unit.

A more specific object of the invention is to prevent exterior condensation on an air conditioning unit by circulating within the unit the condensate formed on the evaporator to prevent pockets of cold condensate from forming therein.

A still more specific object is to provide apparatus to prevent exterior condensation on an air conditioning unit which is economical to manufacture, easy to install and relatively maintenance free.

A further object is to provide apparatus to prevent exterior condensation on an air conditioning unit without the addition of any parts to the unit and without creating any additional assembly or maintenance steps.

Other objects will be apparent from the description to follow and the appended claims. The preceding objects are achieved according to a preferred embodiment of the invention by the provision of a pair of sluiceways in the condenser fan shroud, one on each side of the condenser fan opening and both being in contact with the reservoir created by the base pan in the condenser section of the unit. A condenser fan mounted in the condenser fan opening of the condenser orifice creates sufficient air pressure differentials to cause the condensate to circulate through the sluiceways mixing warm condensate with cold condensate thereby eliminating cold pockets of condensate which result in exterior condensation being formed on the unit.

DESCRIPTION OF THE PREFERRED EMBODIMENT

The embodiment described below is for use in a self contained room air conditioner but it is to be understood that the invention would have like applicability to other types of air conditioning units.

Figure 1:
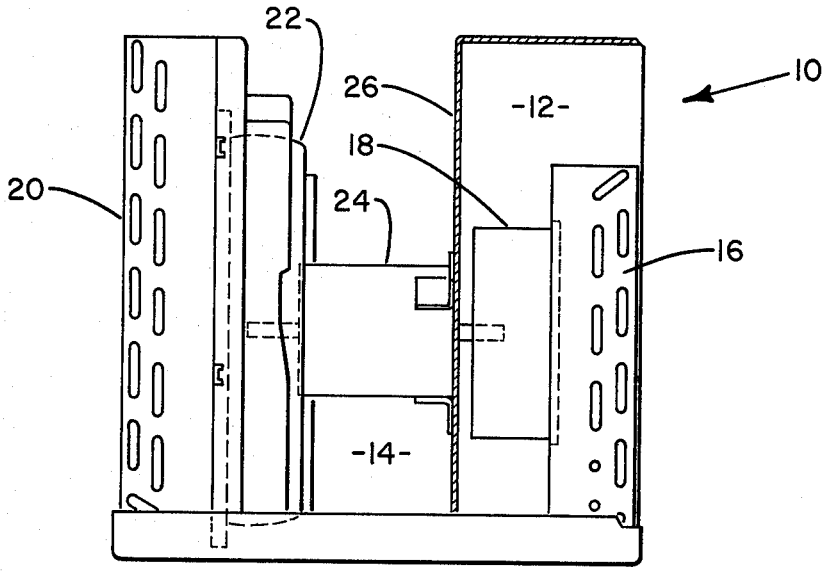
FIG. 1 is a schematic side view of a self-contained room air conditioning unit.

Referring now to the drawings, FIG. 1 shows in schematic form a self contained room air conditioning unit 10 being divided by partition 26 into evaporator section 12 and condenser section 14. The unit is mounted for normal use with evaporator section 12 in communication with the room air to be conditioned. Evaporator section 12 contains evaporator 16 for absorbing heat from the air and evaporator fan 18 for drawing room air through evaporator 16 and venting the conditioned air into the room. (Air intakes and vents are not shown.)

Condenser section 14 of the unit is mounted adjacent to external or outside air. Condenser 20, condenser fan 22 and motor 24 which powers both condenser fan 22 and evaporator fan 18 are mounted in the condenser section.

The condenser fan operates to suck outside air into the condenser section and to force said air out of the unit through the condenser, absorbing heat from the refrigerant at the condenser surfaces. A condenser fan shroud 32 (FIG. 2) is mounted in the condenser section to define a path for air entering condenser section 14 and to guide air from the fan through the condenser. (The vents and discharge area of condenser section 14 are not shown).

The preferred embodiment uses a conventional refrigeration circuit to condition the room air. In addition to the evaporator and condenser, a compressor (not shown) and an expansion device (not shown) are all connected to form a refrigeration circuit. Liquid refrigerant expands to a gas in evaporator 16 absorbing heat from the air and usually reducing the temperature of the evaporator below the dew point temperature of the air passing through evaporator 16. When the temperature of evaporator 16 is below the dew point of the adjacent air, water vapor contained within the air is deposited onto the evaporator surfaces as droplets of liquid water. This water collects and falls into drain pan 36 beneath evaporator 16.

This cold condensate collected in drain pan 36 flows downward through drain pan outlet 38 and through opening 40 in partition 26 to reservoir 30 defined by base pan 28 and partition 26. Base pan 28 has flanges on all sides which form with partition 26 the walls for reservoir 30.

The refrigerant travels from the evaporator 16 through the compressor (not shown) to condenser 20 as in a conventional refrigeration cycle. Heat from the relatively hot refrigerant is absorbed by air in contact with the surfaces of condenser 20 cooling the refrigerant cycling through the condenser.

In the condenser section of the unit, condenser fan shroud 32 is mounted with condenser fan 22 generally contained within condenser fan opening 42 in the condenser fan shroud, said condenser fan shroud defining an air flow path into the condenser section 14 through exterior vents (not shown), through the fan, through condenser 20, and subsequently exited from the unit through a discharge area (not shown).

Mounted to condenser fan 22 is slinger 44, a cylindrical band contacting the condensate in reservoir 30 at slinger opening 46. Upon rotation of the condenser fan through a shaft connected to motor 24, the slinger lifts condensate into the condenser fan airstream to be blown onto condenser 20 whereon the condensate is evaporated thereby increasing the heat transfer efficiency of the condenser and ridding the unit of unwanted condensate.

Figure 2:
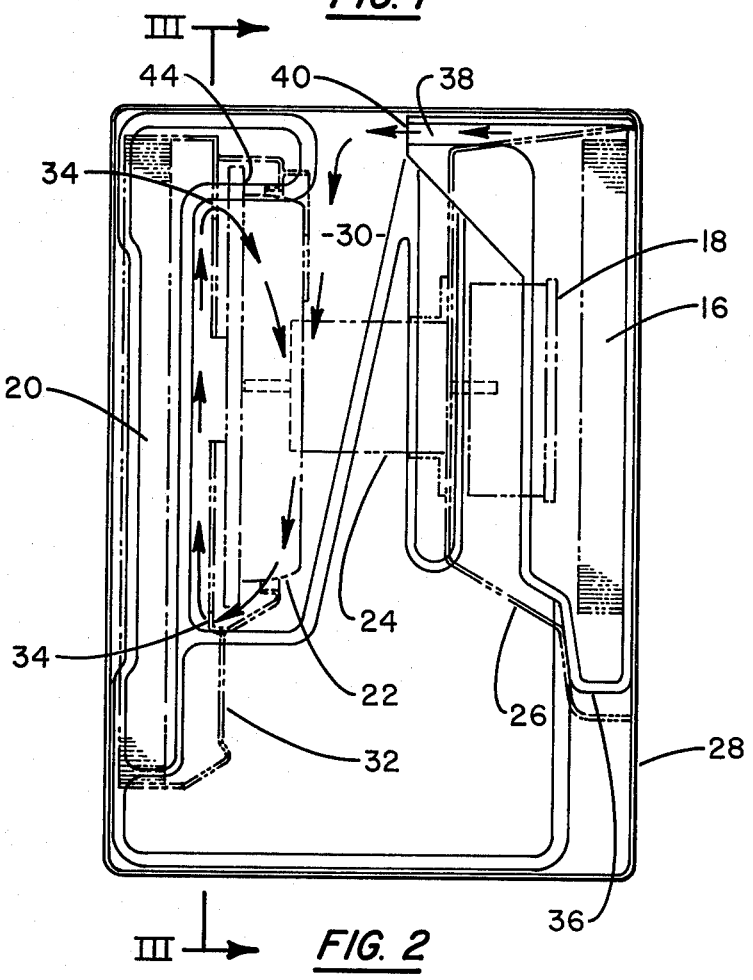
FIG. 2 is a schematic top view of an air conditiong unit showing condensate circulation per the invention.
Figure 3:
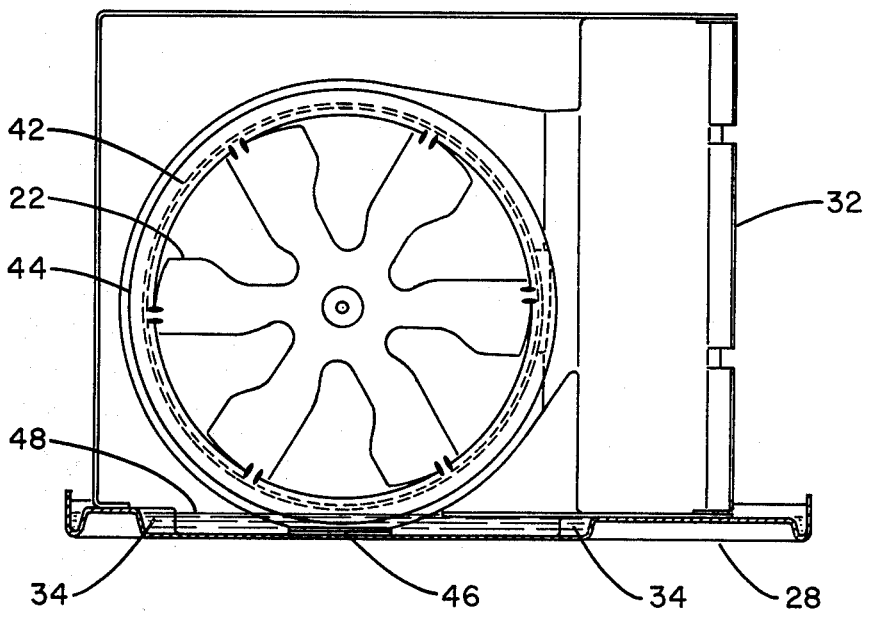
FIG. 3 is a cross section of FIG. 2 at A—A.

Condenser fan shroud 32 which divides reservoir 30 into two parts has contained therein sluiceways 34, one on each side of condenser fan opening 42. (FIGS. 2,3). The sluiceways are located adjacent to base pan 28 and allow for the circulation of condensate between the two sides of condenser fan orifice 32. The rotation of condenser fan 22 creates sufficient air pressure differentials that the condensate from the evaporator in reservoir 30 is forced to circulate within the reservoir. The circulation of the standing reservoir condensate from the evaporator mixes the condensate that has been in the unit for a period of time and as a result has become heated with the much colder condensate arriving from evaporator 16 through opening 40. This mixing causes the overall temperature of the condensate to exceed that temperature at which exterior condensation would form on the outside of the base pan, i.e., the dew point temperature of the adjacent air. Previously in models without insulation, condensation would form in the exterior of the unit adjacent to opening 40 where the coldest condensate contacted base pan 28.

The condenser fan shroud is an integral molding which is assembled by insertion into the unit. The addition of the sluiceways per the invention is accomplished by merely altering the mold to provide openings as a part of the condenser fan orifice. No additional assembly is required as a result of the inclusion of the sluiceways.

From the above description of the preferred embodiment, it is obvious that the objects providing a simple and economical means for eliminating exterior condensation on an air conditioning unit have been met.

Several modifications of the embodiment described herein can be used with the invention. More specifically, the location and number of sluiceways may be altered to provide for different circulation patterns within the reservoir.

The invention has been described in detail with particular reference to a preferred embodiment thereof, but it will be understood that variations and modifications can be effected within the spirit and scope of the invention.

What is claimed is:

1. An air conditioning unit which prevents exterior condensation from forming on the unit being divided by a partition into an evaporator section containing an evaporator on which condensation is formed and a condenser section containing a condenser and a rotatable condenser fan and the unit having a motor to rotate the fan, comprising:

a base pan which defines a reservoir in the condenser section of the unit;

fluid transfer means from the evaporator section to the reservoir; and a condenser fan shroud which divides the reservoir into two parts and which has sluiceways communicating with the reservoir located in the condenser fan shroud, whereby air pressure differentials resulting from fan rotation cause the condensation in the reservoir to circulate through the sluiceways eliminating pockets of cold condensation.

2. Apparatus as set forth in claim 1 where the fluid transfer means consists of a drain pan mounted to collect condensation drippings from the evaporator, an opening in the partition communicating with the reservoir, and a drain pan outlet communicating with the drain pan on one end and the opening in the partition with the other end.

3. Apparatus as set forth in claim 1 wherein there are two sluiceways in the condenser fan shroud one being located on each side of the condenser fan.

4. The method of preventing exterior condensation in an air conditioning unit, said unit being divided by a partition into an evaporator section containing an evaporator on which condensation is formed and a condenser containing a condenser and a rotatable condenser fan, and the unit having a motor to rotate the fan, which comprises:

locating a reservoir in the condenser section of the unit;

transferring condensate from the evaporator to the reservoir;

dividing the reservoir into two parts with a condenser fan shroud containing an opening for the condenser fan; and providing sluiceways in the condenser fan shroud communicating with the reservoir whereby air pressure differentials resulting from rotation of the fan cause the condensation in the reservoir to circulate within the reservoir and through the sluiceways eliminating pockets of cold condensation.

5. The method as set forth in claim 4 wherein the step of providing sluiceways includes having two sluiceways one on each side of the opening for the condenser fan in the condenser fan shroud.

* * * * *